US006004090A

United States Patent [19]

Axelsson

[11] Patent Number: 6,004,090

[45] Date of Patent: Dec. 21, 1999

[54] CHARGING DEVICE FOR A BLAST FURNACE

[75] Inventor: Orjan Axelsson, Nyköpine, Sweden

[73] Assignee: Paul Wurth S.A., Luxembourg, Luxembourg

[21] Appl. No.: 09/154,738

[22] Filed: Sep. 17, 1998

Related U.S. Application Data

[63] Continuation of application No. PCT/SE97/00422, Mar. 12, 1997.

[30] Foreign Application Priority Data

Mar. 29, 1996 [SE] Sweden ..... 9601209

[51] Int. Cl.[6] ..... F27B 11/00

[52] U.S. Cl. ..... 414/206; 414/203

[58] Field of Search ..... 414/167, 169–170, 414/195, 200–206, 221, 292, 301

[56] References Cited

U.S. PATENT DOCUMENTS

| | | | |
|---|---|---|---|
| 3,693,812 | 9/1972 | Mahr et al. | 414/206 X |
| 3,706,387 | 12/1972 | Tokarz | 414/203 X |
| 3,764,027 | 10/1973 | Tokarz | 414/203 X |
| 3,899,088 | 8/1975 | Furuya et al. | 414/206 |
| 3,921,831 | 11/1975 | Takahashi et al. | 414/206 |
| 4,286,912 | 9/1981 | Galow et al. | 414/201 X |
| 4,326,556 | 4/1982 | Deutsch et al. | 137/240 |
| 4,512,702 | 4/1985 | Mailliet et al. | 414/205 X |
| 4,514,129 | 4/1985 | Legille et al. | 414/221 X |
| 5,022,806 | 6/1991 | Lonardi et al. | 414/208 |
| 5,046,908 | 9/1991 | Cimenti et al. | 414/205 X |

FOREIGN PATENT DOCUMENTS

| | | | |
|---|---|---|---|
| 5033020 | 2/1993 | Japan | 414/200 |
| 16604 | 10/1902 | Sweden . | |
| 184094 | 8/1922 | United Kingdom . | |

*Primary Examiner*—James W. Keenan
*Attorney, Agent, or Firm*—Smith, Gambrell & Russell, LLP

[57] ABSTRACT

A charging device for being mounted above the top opening of a blast furnace body. The charging device includes a stationary hopper with a closable lower opening, and a rotary hopper with a closable lower opening with the rotary hopper being arranged below the stationary hopper. The device further includes a rotary cover for covering the top opening of the blast furnace body, with the rotary cover being supported and rotated by the rotary hopper. An annular gas sealing device co-operates with the rotary cover so as to provide a gas-tight seal of the top opening of the blast furnace body, and a rotary chute is supported and rotated by the rotary hopper. The rotary chute points downward into the blast furnace body and is pivotable about a horizontal axis.

11 Claims, 3 Drawing Sheets

CHARGING DEVICE FOR A BLAST FURNACE

CROSS-REFERENCE TO RELATED CASE(S)

The present application is a continuation of PCT/SE97/00422 filed on Mar. 12, 1997, which PCT application is incorporated herein in its entirety.

TECHNICAL FIELD

The present invention relates to a charging device for a blast furnace that has a blast furnace body with an upper opening, and a feeding device for raw materials. The charging device according to the invention comprises one or more hoppers for raw materials which connect a feeding device to the blast furnace.

DESCRIPTION OF THE INVENTION

The object of the present invention is to provide a charging device which in a simple way guarantees the required spreading of the raw materials over the surface of the stock line of the blast furnace. The object is achieved with a charging device according to the invention which is characterized in that it comprises an, in relation to the blast furnace, a rotary hopper fed with raw materials directly or indirectly from the feed device. The rotary hopper is connected to the blast furnace body via a seal arranged to prevent discharge of gas from the blast furnace and that a chute, pivoted about a horizontal axle, is firmly connected with the rotary hopper.

Preferably the rotary hopper supports a cover covering the opening in the blast furnace body, the sealing mentioned being arranged between the cover and the blast furnace body and the chute being placed under the cover pointed downwards into the blast furnace.

The raw materials are spread across the surface of the stock line of the blast furnace by causing the rotary hopper, the cover and the chute altogether to rotate simultaneously as the raw materials flow from the hopper into the chute and across the surface of the stock line. The raw material can be placed as required across the surface by a combination of swinging the chute so that its orifice moves along a radius from the centre of rotation of the device and towards the wall of the blast furnace body and the rotating movement of the rotary hopper.

The rotary hopper is in its lower part connected with a cylinder-shaped mantle showing upper and lower contact flanges towards the rotary hopper and towards the cover of the blast furnace opening respectively. The cylinder-shaped mantle together with the lower part of the rotary hopper can be removed laterally from the charging device which facilitates the repair of the device and after removal of the mantle even allows the cover to be lifted from its waterseal and to remove it for repair. The pivoting chute on its part can be removed separately from the inside of the blast furnace through a special opening in the cover to be renewed or repaired.

Further details and features according to the present invention are evident from the description to the drawings subsequently and from the claims.

BRIEF DESCRIPTION TO DRAWINGS

The invention will be described subsequently as an example of an embodiment in connection with the accompanying drawings.

DETAILED DESCRIPTION OF THE INVENTION

Figure 1:
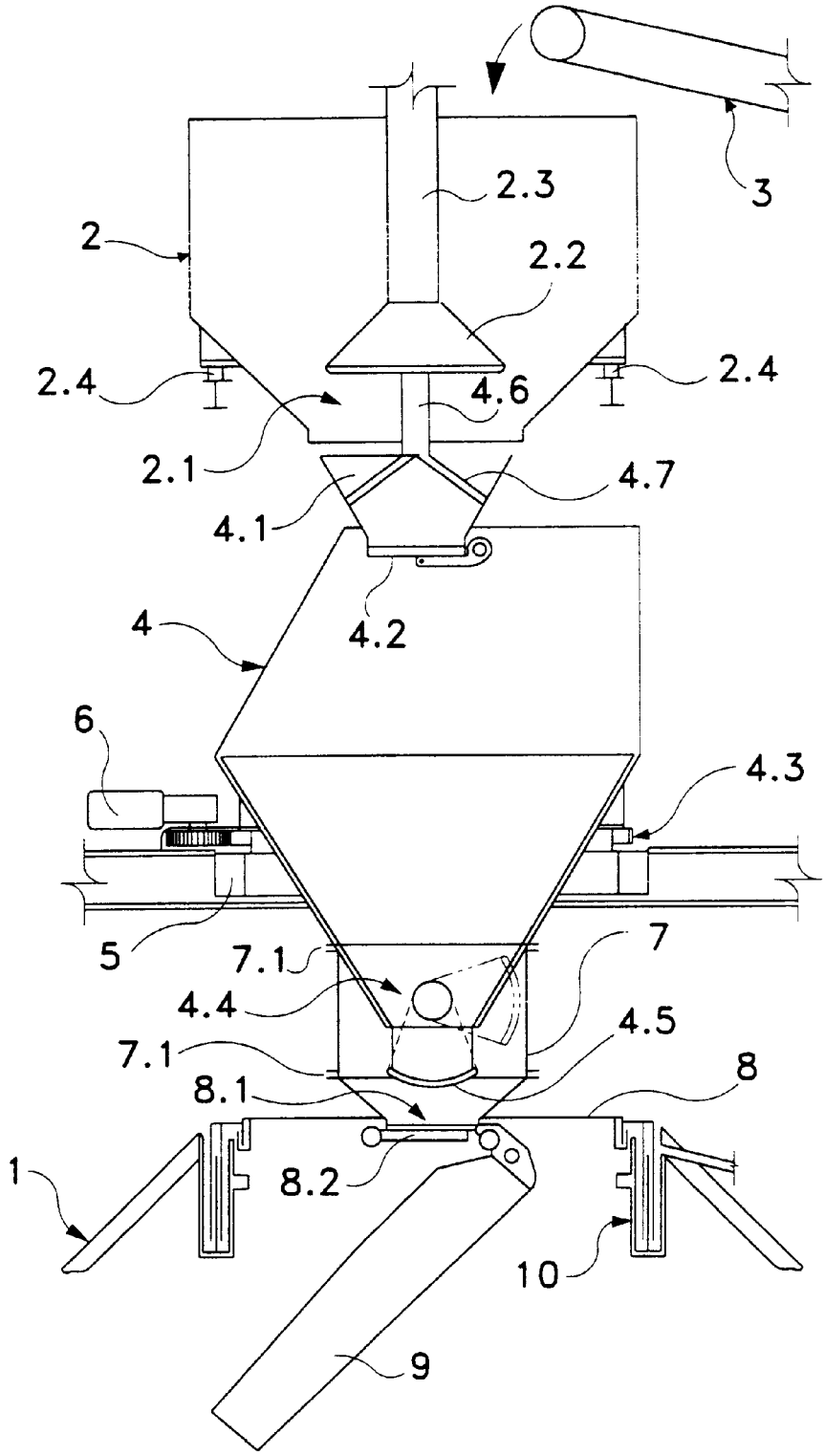
FIG. 1 shows a schematic view of a charging device for a blast furnace according to the invention in a vertical section with a gas seal in the shape of a water-lock.

The charging device according to the invention shown in FIG. 1 is arranged on the top of a blast furnace body 1. The charging device comprises a hopper, which us stationary with regard to the blast furnace body and is cone-shaped toward its lower end. The stationary hopper 2 is fed with raw materials from above by means of a belt conveyor 3. The stationary hopper 2 shows a lower opening 2.1 which can be closed with a vertically adjustable bell 2.2 which is arranged on a first pipe 2.3.

The charging device also comprises a rotary, hopper 4 that is cone-shaped towards its lower end and is arranged between the stationary hopper 2 and the blast furnace body 1. The rotary hopper 4 shows at the top a feed hopper 4.1 which is arranged directly under the lower opening 2.1 in the stationary hopper 2 and which can be closed by a pivoted first, gas-tight valve 4.2. The rotary hopper 4 is supported by a bearing, not shown in the figure, which is placed on a rim 5 surrounding the hopper 4 concerned. The rotation is achieved by means of an electric motor 6 which drives a gear rim 4.3 on the rotary hopper 4 via a driving gear. The rotary hopper 4 shows a lower opening 4.4 which can be closed by a pivoted second valve 4.5 and which is encircled by a cylinder-shaped mantle 7 which at its lower part supports a cover 8 which tightens against the blast furnace body 1.

Electric cables for distribution of electric power for control of the valves and the chute on the rotary hopper 4 run through a central second pipe 4.6 which is connected with the feed hopper 4.1 via spokes 4.7. The second pipe 4.6 sticks up centrally through the stationary hopper 2 and the bell 2.2 and connects to devices not shown in the figure. Hydraulic power, nitrogen and cooling water are delivered via the second pipe 4.6 and the spokes 4.7 as well.

The cylinder-shaped mantle 7 shows contact flanges 7.1 towards the rotary hopper 4 and the cover 8 and contains the lower opening 4.4 and the pivoted second valve 4.5 and is dismountable from the rotary hopper 4 and the cover 8 whereby the second valve 4.5 can be removed and repaired at the same time. On that occasion it is easy to remove and repair the cover 8 as well since it is easy to lift it from the blast furnace body 1.

The cover 8 shows an opening 8.1 which is placed directly under the lower opening 4.4 on the rotary hopper 4 and which con be closed with a pivoted third, gas-tight valve 8.2. Directly under the opening 8.1 in the cover 8 is a chute 9 arranged and pivoted around a horizontal axle on its upper end. The chute 9 is intended to feed raw materials as required across the surface of the stock line of the blast furnace body 1. The device for the rotation of the chute 9 is not shown in the figure. Nor are devices for control of the bell 2.2 according to FIG. 1.

Figure 2:
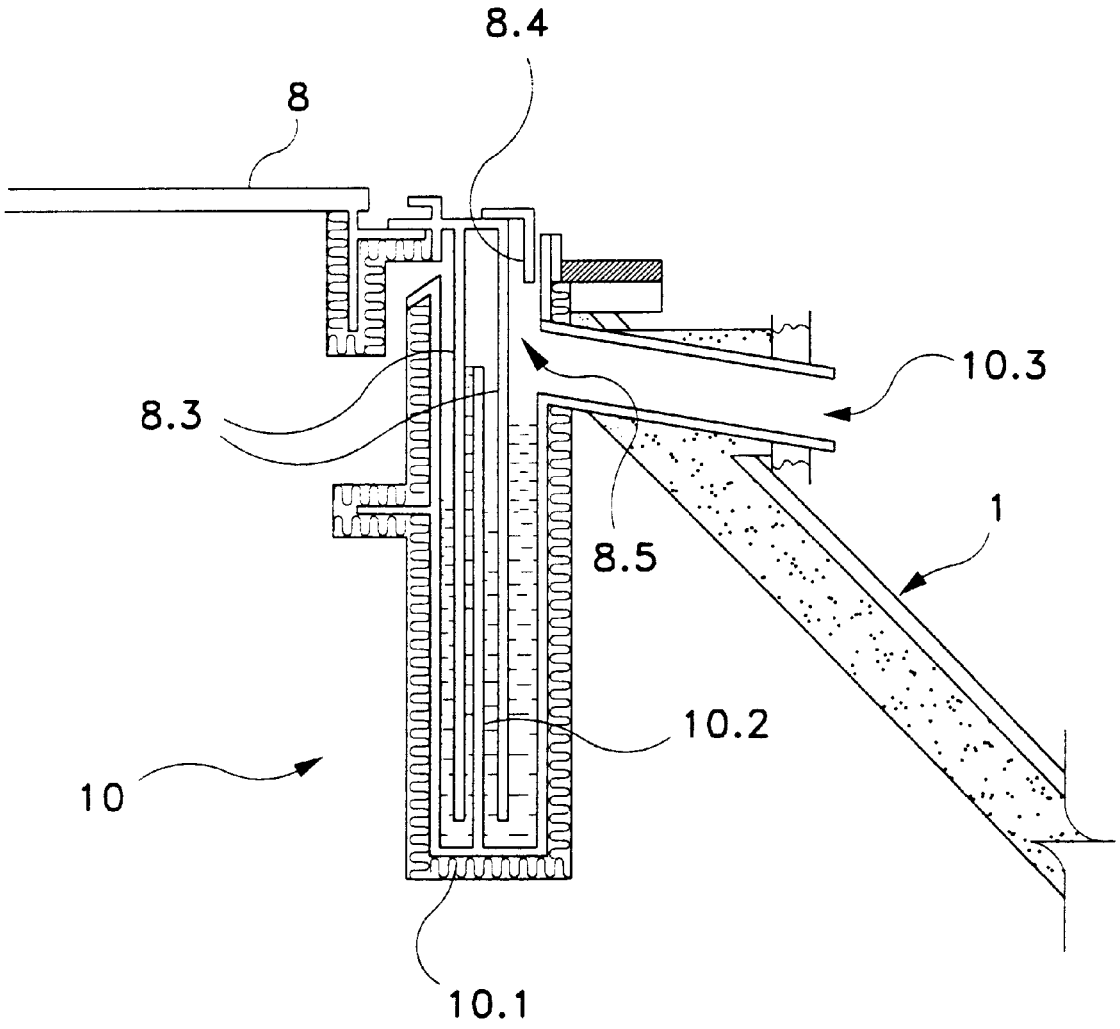
FIG. 2 shows an enlarged detail of the gas sealing water-lock which is a part of FIG. 1.

The gas seal between the cover 8, which rotates together with the hopper 4, and the blast furnace body 1 is a water-lock 10, shown in detail in FIG. 2. The water-lock is a ring-shaped water container 10.1 firmly connected with the blast furnace body 1 and surrounding its upper opening. In the example shown in FIG. 1 the water container 10.1 shows an inner partition-wall 10.2 which divides the container into two ring-shaped spaces. The cover 8 supports two, in relation to the water container 10.1, rotary walls 8.3 each extending downwards on each side of the partition-wall 10.2 in the container 10.1.

The gas pressure inside the blast furnace corresponds to the difference in the water level on both sides of the inner rotary wall 8.3 on cover 8. Replenishment of water takes place continuously via a feeding device, water being allowed to escape from the water-lock through the discharge pipe 10.3. Should the gas pressure in the blast furnace increase occasionally a blow-off of gas and water is prevented by an elastic seal flange 8.4 which seals a slot 8.5 between the blast furnace body 1 and the cover 8. This enables the water-lock 10 to be refilled with water which otherwise would not be possible on account of the outflow of gas.

In charging the blast furnace raw materials will be fed via the belt conveyor 3 to the stationary hopper 2 which in this position is kept closed by means of the bell 2.2. By means of weighing cells 2.4 the delivered material is continuously weighed so that the feed can be stopped when the required amount is fed into the stationary hopper 2. In this position even the feed hopper 4.1 is kept sealed by means of the first valve 4.2. The raw materials then are charged downwards into the rotary hopper by lifting the bell 2.2 and by opening the first valve 4.2, the material falls through the feed hopper 4.1 into the rotary hopper 4, the pivotable second valve 4.5 and the third valve 8.2 being sealed. On that occasion the rotary hopper 4 can be stationary.

The raw materials then is charged downwards into the blast furnace by opening the second valve 4.5 and the third valve 8.2 at the same time as the rotary hopper 4 is brought to rotate around its vertical axle. As even the cover 8 of the blast furnace opening and the associated chute 9 rotate, raw materials fall from the rotary hopper 4 down into the chute 9 and across the surface of the stock line in the blast furnace. The raw materials are spread across the stock line by pivoting the chute 9 inwards or outwards.

Figure 3:
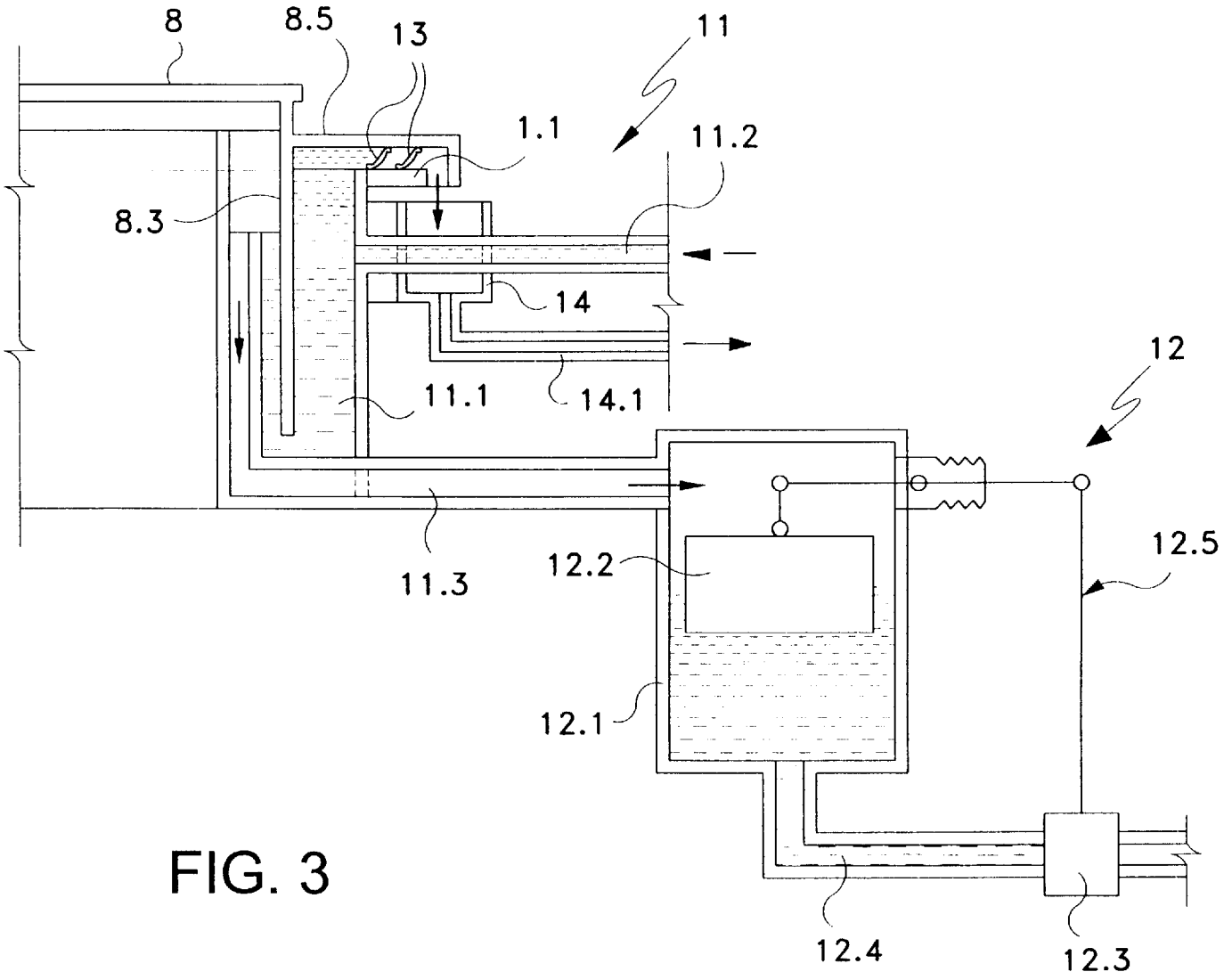
FIG. 3 shows an alternative embodiment of a gas seal comprising sealing lips protected by a water barrier.

The gas seal device 11, shown in FIG. 3, is a ring-shaped water tank 11.1 which surrounds the blast furnace opening and is firmly connected with a ring flange 1.1 in the opening. The cover 8 supports one, in relation to the water tank 11.1, rotary wall 8.3 which extends downwards into the water tank 11.1. Water is fed into the water tank 11.1 through a feed pipe 11.2 and may run off via an overflow pipe 11.3, which is arranged in the shape of a pipe extending vertically through the water tank 11.1, and through the blast furnace mantle to a regulation device 12 comprising a float chamber 12.1 with a floating body 12.2. The floating body 12.2 is connected to a valve 12.3 in a discharge pipe 12.4 via a lever 12.5.

The cover 8 shows a ring-shaped plate 8.5 is positioned above and extend parallel with the level of the ring flange 1.1 provided at the opening to the blast furnace. A seal in the shape of two ring-shaped, elastical lips 13 is arranged between the plate 8.5 and the ring flange 1.1. The seal lips 13 are the. actual gas seal between the blast furnace and the environment.

In operation the blast furnace is under overpressure of about 88 mm wcp (water column pressure) whereby the water in the water tank 11.1 completely fills the space between the vertical wall 8.3 of the cover 8 and the seal lips 13. The water constitutes a protective fence for the seal lips 13 so that they not may be damaged by gases from the blast furnace. Water is continually replenished via the feed pipe 11.2 with overpressure which results in a certain overflow via the overflow pipe 11.3. The outflowing water is collected in the float chamber 12.1 when the valve 12.3 in the discharge pipe 12.4 from the float chamber 12.1 is kept closed. Neither can gas escape through the float chamber 12.1 in this position. When the water in the float chamber 12.1 has reached a certain level the floating body 12.2 will force the valve 12.3 to open by acting on the lever 12.5 so that water escapes through the discharge pipe 12.4. When the water-level again has sunk to the required level the valve again will be closed.

Any water leakage through the seal lips 13 is collected in a ring-shaped slot 14 under a slit between the ring-shaped plate 8.5 and the ring flange 1.1 and is discharged via a discharge pipe 14.1.

In an alternative embodiment of the gas seal device 11 with seal lips 13 water can be fed into the space between the seal lips, collecting leak water partly in the outer ring-shaped slot 14 and partly in an inner ring-shaped slot which replaces the water tank 11.1 mentioned above. Water is then discharged from the base of the inner slot to a float device 12 as above.

In a further alternative embodiment of the gas seal device 11 nitrogen instead of water can be fed into the space between the seal lips 13 totally disposing the necessity of collecting slots.

What is claim is:

1. A charging device for being mounted above the top opening of a blast furnace body, said charging device comprising:

a stationary hopper with a closable lower opening;

a rotary hopper with a closable lower opening, said rotary hopper being arranged below said stationary hopper;

a rotary cover for covering said top opening of said blast furnace body, said rotary cover being supported and rotated by said rotary hopper;

an annular gas sealing device co-operating with said rotary cover so as to provide a gas-tight seal of said top opening of the blast furnace body; and a rotary chute supported and rotated by said rotary hopper, said rotary chute pointing downwards into said blast furnace body and being pivotable about a horizontal axis.

2. The device according to claim 1, wherein said annular gas sealing device includes an annular water-lock.

3. The device according to claim 2 wherein said annular water-lock comprises;

a ring-shaped water tank to be supported on said blast furnace body so as to surround said top opening of said blast furnace body; and at least one rotary annular wall supported by said rotary cover so as to extend downwards into said ring-shaped water tank.

4. The device according to claim 3, wherein:

said ring-shaped water tank includes an inner partition-wall dividing it into two ring-shaped spaces; and said rotary cover includes two rotary annular walls extending downwards on each side of said partition-wall.

5. The device according to claim 2, wherein said annular gas sealing device further includes at least one elastic sealing element arranged in an annular outlet slot of said annular water lock, so that it is protected by said water-lock against direct contact blast furnace gases and prevents a blow-off of gas and water through said annular outlet slot.

6. The device according to claim 2, wherein said annular gas sealing device further includes:

a stationary ring flange to be mounted on said blast furnace body so as to define an annular slot with said rotary cover; and at least one ring-shaped seal lip mounted in said annular slot.

7. The device according to claim 1, further comprising:

a cylinder shaped mantle connecting said rotary hopper to said rotary cover;

a material retaining valve housed inside said cylinder-shaped mantle for closing said lower opening of said rotary hopper;

wherein said cylinder-shaped mantle comprises upper and lower flanges connecting said mantle to said rotary hopper and said rotary cover respectively, so that said mantle can be removed sideways from said charging device with said material retaining valve.

8. The device according to claim 7, wherein said rotary cover comprises a central material discharge opening and a gas-tight valve for closing said central material discharge opening.

9. The device according to claim 1, further comprising a vertically adjustable bell arranged on a vertical first pipe-shaped member in said stationary hopper, so as to be capable of closing said lower opening of said stationary hopper.

10. The device according to claim 9, further comprising:

a rotary vertical second pipe-shaped member arranged inside said vertical first pipe-shaped member and connected to said rotary hopper via one or more arms; and said vertical second pipe-shaped member providing a passageway for fluid pipes or cables running therethrough.

11. The device according to claim 1, wherein said rotary hopper has an upper opening, which is arranged under the lower opening in said stationary hopper, and includes a gas-tight valve associated with said upper opening.

* * * * *